US005991938A

United States Patent [19]

Bonior

[11] Patent Number: 5,991,938

[45] Date of Patent: Nov. 30, 1999

[54] POTTY TRAINER AND DESK COMBINATION

[76] Inventor: Jamela Bonior, 15149 S. Oxford Dr., Oak Forest, Ill. 60452

[21] Appl. No.: 09/036,413

[22] Filed: Mar. 5, 1998

[51] Int. Cl.[6] ..... A47K 11/04

[52] U.S. Cl. ..... 4/478; 4/483

[58] Field of Search ..... 4/476, 478, 483

[56] References Cited

U.S. PATENT DOCUMENTS

| | | | |
|---|---|---|---|
| 1,482,073 | 1/1924 | Ferdinand | 4/483 X |
| 1,947,373 | 2/1934 | Bickel | 4/478 |
| 5,781,939 | 7/1998 | Bledsoe | 4/483 |

*Primary Examiner*—Robert M. Fetsuga

[57] ABSTRACT

A potty trainer is provided including a chair having an opening for receiving waste from a seated child. Also included is a desk coupled to the chair for providing a working surface.

1 Claim, 2 Drawing Sheets

FIG. 1
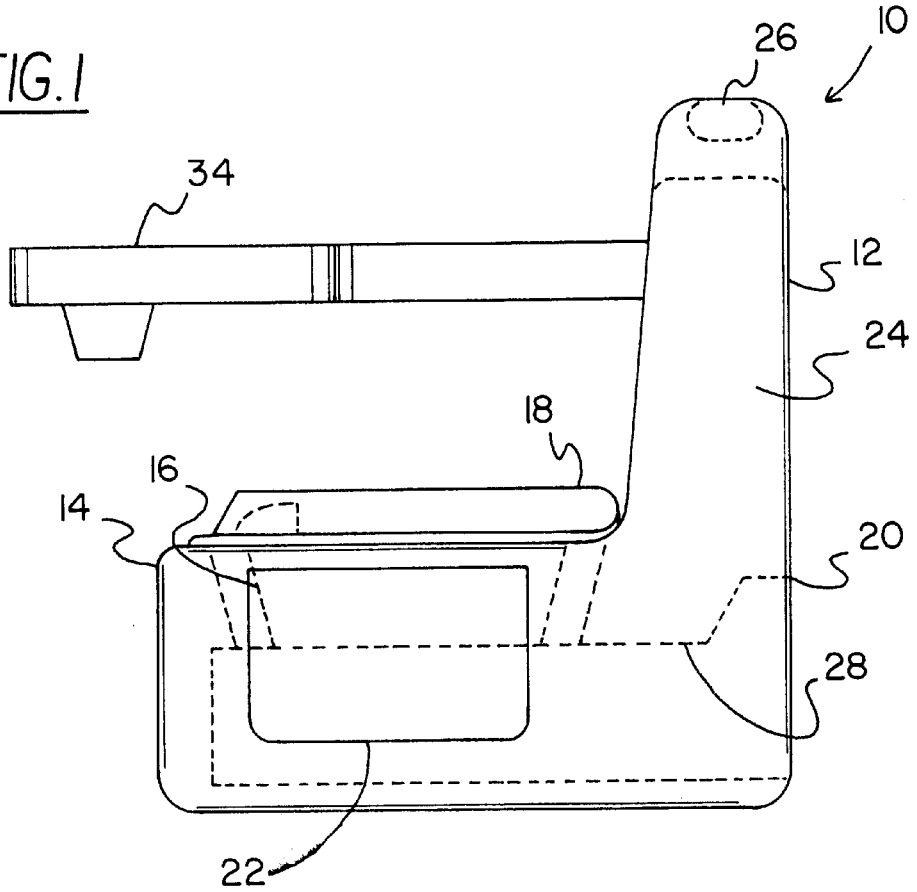
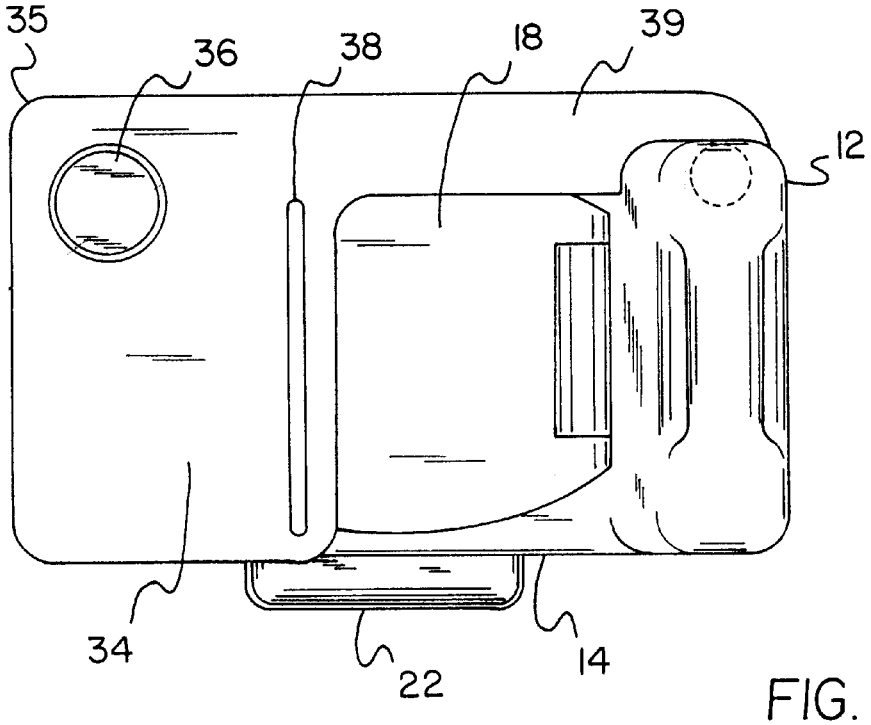
FIG. 2

POTTY TRAINER AND DESK COMBINATION

BACKGROUND OF THE INVENTION

1. Field of the Invention

The present invention relates to potty trainers and more particularly pertains to a new potty trainer and desk combination for facilitating potty training.

2. Description of the Prior Art

The use of potty trainers is known in the prior art. More specifically, potty trainers heretofore devised and utilized are known to consist basically of familiar, expected and obvious structural configurations, notwithstanding the myriad of designs encompassed by the crowded prior art which have been developed for the fulfillment of countless objectives and requirements.

Known prior art potty trainers include U.S. Pat. No. 5,309,580; U.S. Pat. No. 5,369,820; U.S. Pat. No. 4,777,680; U.S. Pat. No. 4,777,672; U.S. Patent Des. 361,625; and U.S. Pat. No. 35,633.

In these respects, the potty trainer and desk combination according to the present invention substantially departs from the conventional concepts and designs of the prior art, and in so doing provides an apparatus primarily developed for the purpose of facilitating potty training.

SUMMARY OF THE INVENTION

In view of the foregoing disadvantages inherent in the known types of potty trainers now present in the prior art, the present invention provides a new potty trainer and desk combination construction wherein the same can be utilized for facilitating potty training.

The general purpose of the present invention, which will be described subsequently in greater detail, is to provide a new potty trainer and desk combination apparatus and method which has many of the advantages of the potty trainers mentioned heretofore and many novel features that result in a new potty trainer and desk combination which is not anticipated, rendered obvious, suggested, or even implied by any of the prior art potty trainers, either alone or in any combination thereof.

To attain this, the present invention generally comprises a chair comprising a seat portion having a generally rectangular configuration. The seat portion is equipped with a top face, a roughened non-skid bottom face, a front face, a rear face and a pair of side faces thereby defining an interior space. As shown in FIG. 1, the top face has an opening formed therein for allowing access to an interior space of the seat portion. The opening preferably has a peripheral edge with an inverted frusto-conical configuration. Further, a lid is hingably coupled over the opening for selectively precluding access to the interior space. The rear face of the seat portion has a cut out formed therein also for allowing access to the interior space of the seat portion. For affording a storage space, a first one of the side faces of the seat portion has a rigid pocket mounted thereon with an open top. The chair further includes a back rest portion integrally coupled to the top face of the seat portion adjacent to the rear face thereof and extended upwardly therefrom. As shown in FIG. 1, the back rest portion has a vertical rear face and a beveled front face. A top edge of the back rest portion has an oval hole formed adjacent thereto for defining a handle. FIG. 4 shows a removable tray having a rectangular configuration. A recess is formed in a top face of the tray adjacent to its front. Mounted to the top face of the tray adjacent to its rear is an upstanding extent. Such upstanding extent is equipped with a beveled front surface and a rear surface. A handle groove is formed in the rear surface of the upstanding extent for facilitating the manual insertion and removal of the tray with respect to the interior space of the chair. As such, waste may be deposited through the opening and into the tray. Finally, a desk includes an outboard working plate with a rectangular planar configuration. A drink recess is situated in an outboard corner of the outboard working plate. An elongated protrusion is positioned along an inboard edge of the outboard working plate for precluding articles from rolling off the desk. The desk further includes an inboard arm mounted to the inboard edge of the outboard working plate adjacent a side thereof. The inboard arm of the desk extends rearwardly from the working plate for being pivotally coupled to a side face of the back rest of the chair. By this coupling, the desk is pivoted within a horizontal plane.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new potty trainer and desk combination apparatus and method which has many of the advantages of the potty trainers mentioned heretofore and many novel features that result in a new potty trainer and desk combination which is not anticipated, rendered obvious, suggested, or even implied by any of the prior art potty trainers, either alone or in any combination thereof.

It is another object of the present invention to provide a new potty trainer and desk combination which may be easily and efficiently manufactured and marketed.

It is a further object of the present invention to provide a new potty trainer and desk combination which is of a durable and reliable construction.

An even further object of the present invention is to provide a new potty trainer and desk combination which is susceptible of a low cost of manufacture with regard to both materials and labor, and which accordingly is then susceptible of low prices of sale to the consuming public, thereby making such potty trainer and desk combination economically available to the buying public.

Still yet another object of the present invention is to provide a new potty trainer and desk combination which provides in the apparatuses and methods of the prior art some of the advantages thereof, while simultaneously overcoming some of the disadvantages normally associated therewith.

Still another object of the present invention is to provide a new potty trainer and desk combination for facilitating potty training.

Even still another object of the present invention is to provide a new potty trainer and desk combination that includes a chair having an opening for receiving waste from a seated child. Also included is a desk coupled to the chair for providing a working surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side view of a new potty trainer and desk combination according to the present invention.

FIG. 2 is a top view of the present invention.

DESCRIPTION OF THE PREFERRED EMBODIMENT

Figure 3:
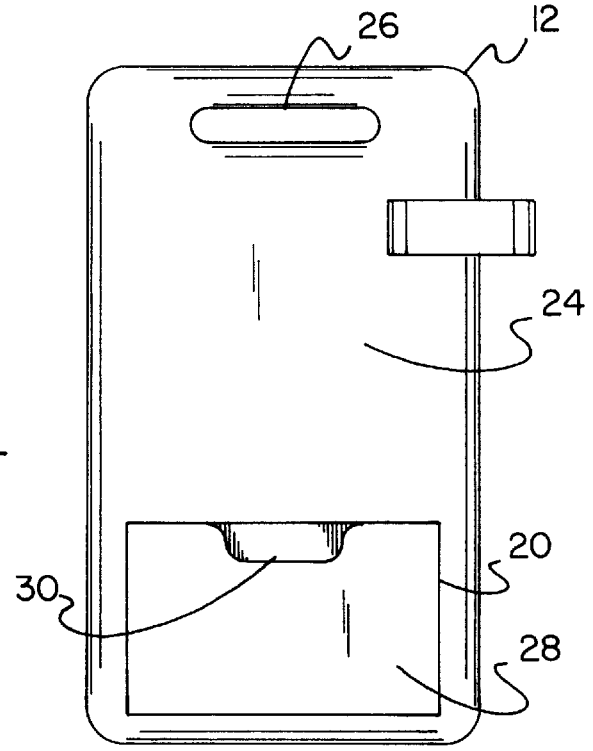
FIG. 3 is a rear view of the present invention.

With reference now to the drawings, and in particular to FIGS. 1 through 4 thereof, a new potty trainer and desk combination embodying the principles and concepts of the present invention and generally designated by the reference numeral 10 will be described.

The present invention, designated as numeral 10, includes a chair 12 comprising a seat portion 14 having a generally rectangular configuration. The seat portion is equipped with a top face, a roughened 40, a front face, a rear face and a pair of side faces thereby defining an interior space. As shown in FIG. 1, the top face has an opening 16 formed therein for allowing access to an interior space of the seat portion. The opening preferably has a peripheral edge with an inverted frusto-conical configuration.

Further, the seat portion has a lid 18 hingably coupled over the opening for selectively precluding access to the interior space. The rear face of the seat portion has a cut out 20 formed therein also for allowing access to the interior space of the seat portion. For affording a storage space, a first one of the side faces of the seat portion has a rigid pocket 22 mounted thereon with an open top. It is imperative the pocket have a width of no more than 1 inch to preventing catching a foot of a user. Further, a recessed upper edge may optionally be incorporated with the pocket for facilitating the removal of a book therein.

The chair further includes a back rest portion 24 integrally coupled to the top face of the seat portion adjacent to the rear face thereof and extended upwardly therefrom. As shown in FIG. 1, the back rest portion has a vertical rear face and a beveled front face. A top edge of the back rest portion has an oval hole 26 formed adjacent thereto for defining a handle.

Figure 4:
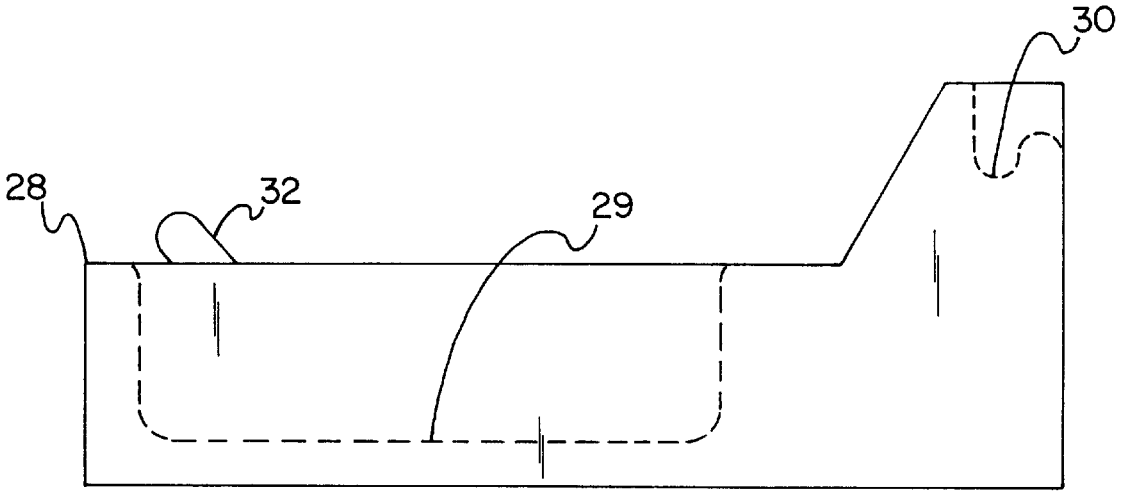
FIG. 4 is a side view of the tray of the present invention.

FIG. 4 shows a removable tray 28 having a rectangular configuration. A recess 29 is formed in a top face of the tray adjacent to its front. Mounted to the top face of the tray adjacent to its rear is an upstanding extent. Such upstanding extent is equipped with a beveled front surface and a rear surface. A handle groove 30 is formed in the rear surface of the upstanding extent for facilitating the manual insertion and removal of the tray with respect to the interior space of the chair. As such, waste may be deposited through the opening of the chair and into the tray. It should be noted that an elongated catch 32 may optionally be pivotally coupled along a front edge of the recess for directing spray from male users into the recess during use. Note FIG. 4. Such catch is pivotable so as to allow removal of the tray from the chair.

Finally, a desk 34 includes an outboard working plate 35 with a rectangular planar configuration. A drink recess 36 is situated in an outboard corner of the outboard working plate. An elongated protrusion 38 is positioned along an inboard edge of the outboard working plate for precluding articles from rolling off the desk.

The desk further includes an inboard arm 39 mounted to the inboard edge of the outboard working plate adjacent a side thereof. The inboard arm of the desk extends rearwardly from the working plate in coplanar relationship therewith. The inboard arm is pivotally coupled to a side face of the back rest of the chair. In the preferred embodiment, the arm is coupled to a side of the chair opposite that on which the pocket is mounted. By this coupling, the desk is pivotable within a horizontal plane over a range of about 90 degrees.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A potty trainer comprising, in combination:

a chair including a seat portion having a generally rectangular configuration with a top face, a front face, a rear face and a pair of side faces thereby defining an interior space, the top face having an opening formed therein for allowing access to an interior space of the seat portion with the opening having a peripheral edge with an inverted frusto-conical configuration and a lid coupled over the opening for selectively precluding access to the interior space, the rear face having a cut out formed therin also for allowing access to the interior space of the seat portion, a first one of the side faces of the seat portion having a rigid pocket mounted thereon with an open top for storage purposes, the chair further including a back rest portion integrally coupled to the top face of the seat portion adjacent to the rear face thereof and extended upwardly therefrom, the back rest portion having a vertical rear face and a beveled front face, wherein a top edge of the back rest portion has an oval hole formed adjacent thereto for defining a handle;

a removable tray having a rectangular configuration with a recess formed in a top face thereof adjacent to its front, the tray further including and upstanding extent mounted to the top face thereof adjacent to its rear, the upstanding extent having a beveled front surface and a rear surface with a handle groove formed therein for facilitating the manual insertion and removal of the tray with respect to the interior space of the chair such that waste may be deposited through the opening and into the tray; and a desk including an outboard working plate with a rectangular planar configuration having a drink recess formed in and outboard corner thereof and an elongated protrusion formed along an inboard edge of the outboard working plate for precluding articles from rolling off the desk, the desk further including an inboard arm mounted to the inboard edge of the outboard working plate adjacent a side thereof and extending rearwardly therefrom and being coupled to a side face of the back rest of the chair.

* * * * *